US010126106B1

(12) United States Patent
Langner

(10) Patent No.: US 10,126,106 B1
(45) Date of Patent: Nov. 13, 2018

(54) METHODS AND APPARATUS FOR RELEASABLY COUPLING SHOCK TUBE TO A DISRUPTER

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 0 days.

(21) Appl. No.: 15/720,112

(22) Filed: Sep. 29, 2017

Related U.S. Application Data

(60) Provisional application No. 62/403,132, filed on Oct. 1, 2016.

(51) Int. Cl.
*F41A 19/55* (2006.01)
*F42D 5/04* (2006.01)
*F41A 19/25* (2006.01)

(52) U.S. Cl.
CPC ..... *F42D 5/04* (2013.01); *F41A 19/25* (2013.01); *F41A 19/55* (2013.01)

(58) Field of Classification Search
CPC . F41H 11/12; F42D 5/04; F41A 19/25–19/27; F41A 19/55–19/56; F41A 25/26; F42B 33/067
USPC ... 89/1.13, 42.01, 37.1, 37.04, 37.05, 40.02, 89/40.05, 40.06, 40.14; 86/50; 102/401–403; 42/94, 69.01, 135
See application file for complete search history.

(56) References Cited

U.S. PATENT DOCUMENTS 4,169,403 A * 10/1979 Hanson ..... F42B 33/062 102/293
4,932,308 A * 6/1990 Arene ..... F41A 1/08 89/1.705
5,134,921 A * 8/1992 Breed ..... F41A 23/06 86/50
5,136,920 A * 8/1992 Breed ..... F41A 23/06 102/430
5,743,246 A * 4/1998 Mattern ..... B09B 3/0058 124/56
6,408,731 B1 * 6/2002 Elsener ..... F41A 1/10 102/440
6,439,127 B1 * 8/2002 Cherry ..... F42B 12/36 102/402
8,479,435 B1 * 7/2013 Gladwell ..... F41G 3/165 102/402
8,915,004 B1 * 12/2014 Langner ..... F42B 33/06 124/65
9,200,881 B1 * 12/2015 Langner ..... F42B 33/06
9,322,625 B1 * 4/2016 Langner ..... F42B 33/062
9,488,429 B1 * 11/2016 Langner ..... F41A 25/26
2003/0041724 A1 * 3/2003 Ebersole, Jr. ..... F41A 25/06 89/42.01
2009/0178548 A1 * 7/2009 Tyas ..... F41B 9/0046 86/50

(Continued)

*Primary Examiner* — John Cooper
(74) *Attorney, Agent, or Firm* — Lawrence Letham; Letham Law Firm LLC

(57) ABSTRACT

A coupler for coupling shock tube to a disrupter cannon so that the shock tube automatically decouples from the coupler and thereby from the disrupter cannon after the disrupter cannon has been fired to launch a projectile. The coupler retains the shock tube with a force that is greater than the force provided by the shock tube when it is ignited, but is less than the force of a reflected wave of pressure out of the disrupter cannon after the disrupter cannon has been fired.

19 Claims, 4 Drawing Sheets

(56) References Cited

U.S. PATENT DOCUMENTS

| | | | | |
|---|---|---|---|---|
| 2009/0265973 | A1* | 10/2009 | Calvete Zumalde | F41A 3/74 42/51 |
| 2012/0137558 | A1* | 6/2012 | Lizarralde Ibarguren | F41A 3/30 42/51 |
| 2012/0180644 | A1* | 7/2012 | Langner | F41A 25/00 89/42.01 |
| 2014/0090285 | A1* | 4/2014 | Peterson | F41A 3/00 42/51 |
| 2014/0245878 | A1* | 9/2014 | Langner | F41A 25/06 86/50 |
| 2014/0245880 | A1* | 9/2014 | Rabec Le Gloahec | F41G 3/00 89/1.13 |
| 2015/0013202 | A1* | 1/2015 | Hendricks | F42B 5/025 42/51 |
| 2017/0307347 | A1* | 10/2017 | Peterson, Sr. | F42B 30/02 |

* cited by examiner

METHODS AND APPARATUS FOR RELEASABLY COUPLING SHOCK TUBE TO A DISRUPTER

FIELD OF THE INVENTION

Embodiments of the present invention relate to disrupter cannons which are used by bomb squads to disable or destroy explosive devices including improvised explosive devices ("IEDs").

BRIEF DESCRIPTION OF THE SEVERAL VIEWS OF THE DRAWING

Embodiments of the present invention will be described with reference to the drawing, wherein like designations denote like elements, and.

BACKGROUND

Figure 1:
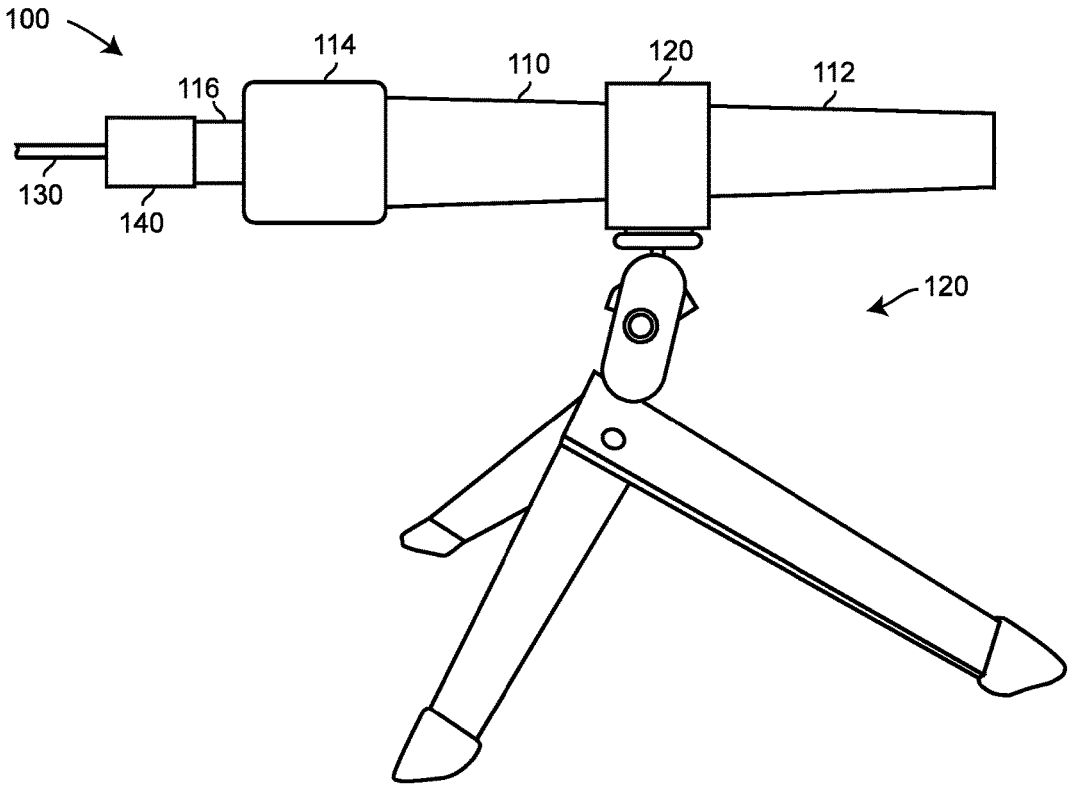
FIG. 1 is a diagram of a system for disabling explosive devices, according to various aspects of the present disclosure.

Disrupter cannons, also referred to as disrupters or cannons, are used by military, bomb squad, and other emergency personnel to destroy or disable explosive devices such as IEDs, bombs, and ordinance.

A disrupter cannon launches a projectile toward an explosive device. The projectile impacts and disrupts components within the explosive device to disable or destroy the explosive device or to facilitate personnel in disabling or destroying the explosive device.

In operation, a projectile and a cartridge are inserted into the disrupter cannon. The cartridge includes a primer and an explosive charge (e.g., pyrotechnic, gun powder). The cannon is aimed toward (e.g., at) the explosive device. A mount (e.g., tripod) may be used to position the disrupter to aim the disrupter toward the explosive device. The cartridge is activated (e.g., ignited) and a rapidly expanding gas from the cartridge propels the projectile from a barrel of the cannon toward the explosive device.

In conventional disrupters, shock tube is used to actuate (e.g., move) a firing pin in the disrupter to ignite the cartridge to launch the projectile. In present disrupter cannons, the shock tube is coupled to the disrupter using a plastic retention nut or a fitting that encircles the shock tube with fingers that grip the shock tube. A problem with present shock tube connectors is that it is time consuming to connect the shock tube to the disrupter cannon and even more time consuming to disconnect the shock tube from the disrupter cannon after the disrupter cannon has been fired. Unfortunately, the tactical environment while disabling an explosive device is critical and every second counts.

Personnel that use disrupter cannons would benefit from a coupler that enables shock tube to be quickly coupled to (e.g., connected to, inserted into) the disrupter cannon. Such personnel would further benefit from a coupler that automatically (e.g., without human intervention, without intervention by a user) decouples (e.g., disconnects) from the shock tube responsive to firing the disrupter cannon. Automatic disconnection of the shock tube from the disrupter cannon would efficiently make the disrupter cannon ready to set up to disable another explosive device.

DETAILED DESCRIPTION OF INVENTION

A disrupter cannon may be used to launch a projectile toward an explosive device to disable or destroy the explosive device as discussed above. As further discussed above, shock tube may be used to ignite a cartridge in the disrupter cannon to launch the projectile.

A disrupter cannon may include a firing pin. Prior to firing the disrupter cannon, the firing pin is positioned away from the primer of the cartridge. Shock tube is a tubing that contains an explosive powder (e.g., gun powder, pyrotechnic) inside the tube. To launch the projectile from the disrupter cannon, the shock tube is coupled to an orifice in the disrupter cannon that is in fluid communication with the firing pin via a passage. Igniting the explosive powder in the shock tube causes a rapidly expanding gas to exit the shock tube and to enter the orifice. The rapidly expanding gas from the shock tube travels through the passage to the firing pin. The rapidly expanding gas exerts a force on the firing pin that moves the firing pin toward the cartridge. The force causes the firing pin to strike (e.g., impact, hit) the primer thereby igniting the primer. The primer ignites the explosive charge in the cartridge. The explosive charge burns to produce a rapidly expanding gas that propels the projectile from the disrupter cannon toward the explosive device.

According to various aspects of the present disclosure, a coupler may be used to couple the shock tube to the disrupter cannon. A coupler permits the rapidly expanding gas from the shock tube to pass through the coupler to the passage where the rapidly expanding gas moves the firing pin to ignite the cartridge to launch the projectile.

Prior to igniting the explosive powder inside the shock tube, the gas pressure inside the shock tube, the coupler, and the passage that leads to the firing pin is about atmospheric pressure. The rapidly expanding gas that results from igniting the pyrotechnic inside the shock tube increases the gas pressure inside the shock tube, the coupler and the passage in the disrupter cannon. The magnitude of the gas pressure that first results from igniting the explosive powder inside the shock tube is referred to herein as the firing-pressure. The firing-pressure provides the force that moves the firing pin toward the primer of the cartridge.

As the firing pin is moved by the rapidly expanding gas from the shock tube to its furthest extent (e.g., striking the primer), the rapidly expanding gas has no outlet, so the gas pressure inside the disrupter cannon increases above the firing-pressure. The increase in the gas pressure is referred to herein as the back-pressure.

The back-pressure travels backward (e.g., away) from the firing pin into the coupler so that the gas pressure in the coupler increases. The back-pressure may be used to release (e.g., disconnect, decouple) the shock tube from the coupler so that the shock tube disconnects from the coupler and thereby from the disrupter cannon responsive to firing the disrupter cannon. The release of the shock tube from the coupler and thereby from the disrupter cannon is performed without human intervention (e.g., automatically).

Figure 2:
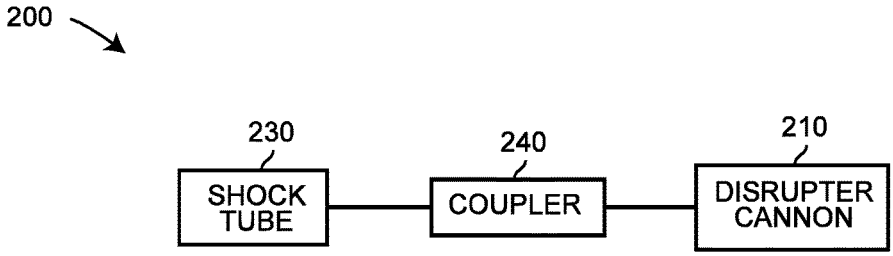
FIG. 2 is a functional block diagram of a system for disabling explosive devices.

Systems 100 and 200 of FIGS. 1-2 are systems for disabling explosive devices. System 200 is a block diagram that includes shock tube 230, coupler 240, and disrupter cannon 210. System 100 is an implementation of a system for disabling explosive devices. System 100 includes shock tube 130, coupler 140, disrupter cannon 110, and mount 120. Disrupter cannon 110 includes barrel 112, breach cap 114, and firing mechanism 116. Firing mechanism 116 includes a firing pin as discussed above. Breach cap 114 may be removed from barrel 112 to insert a projectile and a cartridge into barrel 112. The cartridge launches the projectile from barrel 112 toward a target.

Shock tube 130, coupler 140, and disrupter cannon 110 perform the functions of shock tube 230, coupler 240, and disrupter cannon 210 respectively. Any disclosure regarding shock tube 130, coupler 140, and disrupter cannon 110 applies to shock tube 230, coupler 240, and disrupter cannon 210 respectively whether or not expressly stated. Shock tube 130 and 230 perform the functions of shock tube discussed above. Coupler 140 and 240 perform the functions of a coupler discussed above. Disrupter cannon 110 and 210 perform the functions of a disrupter cannon discussed above.

Coupler 140 mechanically couples to disrupter cannon 110. An outlet of coupler 140 couples to an inlet of disrupter cannon 110. The inlet of disrupter cannon 110 is in fluid communication with a passage of disrupter cannon 110 that leads to the firing pin (not shown).

Shock tube 130 mechanically couples to coupler 140. Shock tube 130 couples to coupler 140 such that the interior (e.g., inner portion, hollow, passage) of shock tube 130 is in fluid communication with a passage in coupler 140 that leads to the outlet of coupler 140 and the inlet of disrupter cannon 110. While shock tube 130 is mechanically coupled to coupler 140 and coupler 140 is mechanically coupled to disrupter cannon 110, the interior of shock tube 130 is in fluid communication with the firing pin.

Igniting the explosive powder in shock tube 130 causes a rapidly expanding gas to exit shock tube 130, enter coupler 140, exit coupler 140, enter disrupter cannon 110, and to move along the passage to the firing pin. Upon reaching the firing pin, the rapidly expanding gas exerts a force on the firing pin that moves the firing pin forward, with respect to the direction of travel of the projectile. Once the firing pin moves to its furthest extent (e.g., reach, firing position), the rapidly expanding gas has no outlet. Because there is no outlet to vent the expanding gas from the system, the gas pressure in the passage of disrupter cannon 110 increases. The increased gas pressure reflects like a wave from the firing pin backward out of the passage of disrupter cannon 110 and into coupler 140.

The force (e.g., psi, pressure) of the reflected pressure, referred to above as the back-pressure, is greater than the force provided by the rapidly expanding gas when shock tube 130 was first ignited, which is referred to above as the firing-pressure. The increased pressure of the gas in coupler 140 operates (e.g., acts, presses) on the end portion of shock tube 130 that is positioned in coupler 140 to eject (e.g., push, expel) shock tube 130 from coupler 140.

Because the force provided by the back-pressure is greater than the firing-pressure, the back-pressure moves shock tube 130 out of coupler 140 to decouple shock tube 130 from coupler 140 and thereby from disrupter cannon 110. Whereas the firing-pressure, produced when shock tube 130 is first ignited, is not sufficient to decouple shock tube 130 from coupler 140. Because (1) the force provided at the firing-pressure is not sufficient to decouple shock tube 130 from coupler 140; (2) the back-pressure is sufficient to decouple shock tube 130 from coupler 140; and (3) the gas pressure in disrupter cannon 110 and coupler 140 rises to the level of the back-pressure after the expanding gas moves the firing pin, shock tube 130 does not disconnect from coupler 140 until after it has served its purpose of firing disrupter cannon 110. In other words, shock tube 130 remains coupled to coupler 140 and thereby to disrupter cannon 110 prior to firing disrupter cannon 110. Prior to firing disrupter cannon 110, shock tube 130 remains coupled to coupler 140 during setup, positioning, and aiming of disrupter cannon 110, yet shock tube 130 automatically disconnects from coupler 140 upon firing disrupter cannon 110. Further, shock tube 130 decouples from coupler 140 without user intervention.

Coupler 400, shown in FIGS. 4-8, is an implementation of coupler 140 or coupler 240. Coupler 400 performs all of the functions of coupler 140 and a coupler discussed above. The disclosure regarding coupler 400 is applicable to coupler 140 and 240 even though not expressly stated. Couper 400 includes inlet 410, outlet 420, face 430, threads 440, and passage 450. Coupler 400 in FIGS. 4-8 is drawn to scale.

Figure 5:
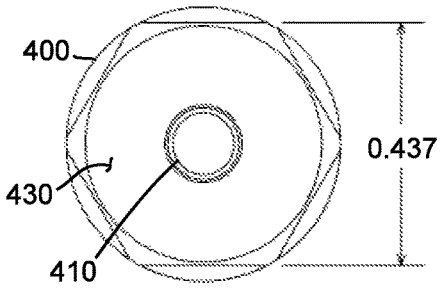
FIG. 5 is a to-scale view of the front of the coupler of FIG. 4.
Figure 6:
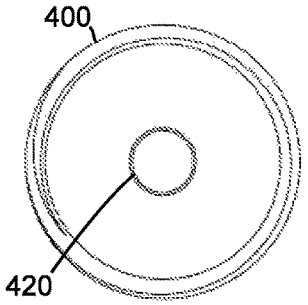
FIG. 6 is a to-scale view of the rear of the coupler of FIG. 4.
Figure 7:
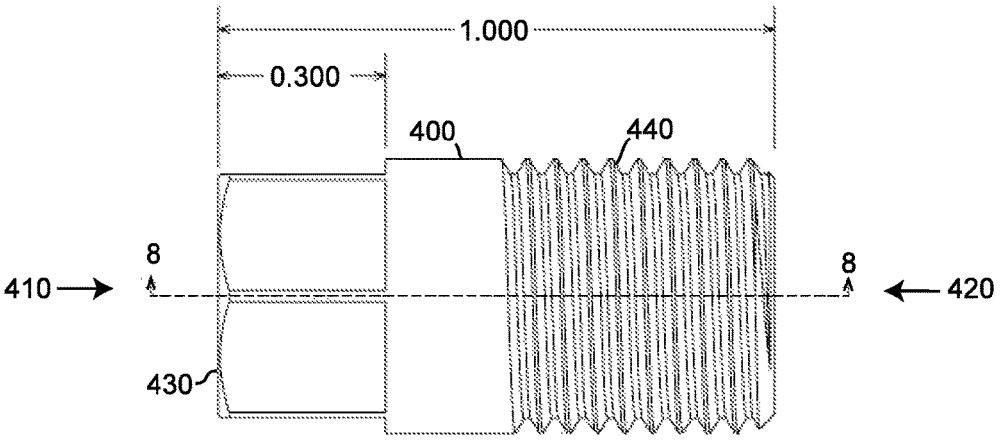
FIG. 7 is a to-scale view of the side of the coupler of FIG. 4.
Figure 8:
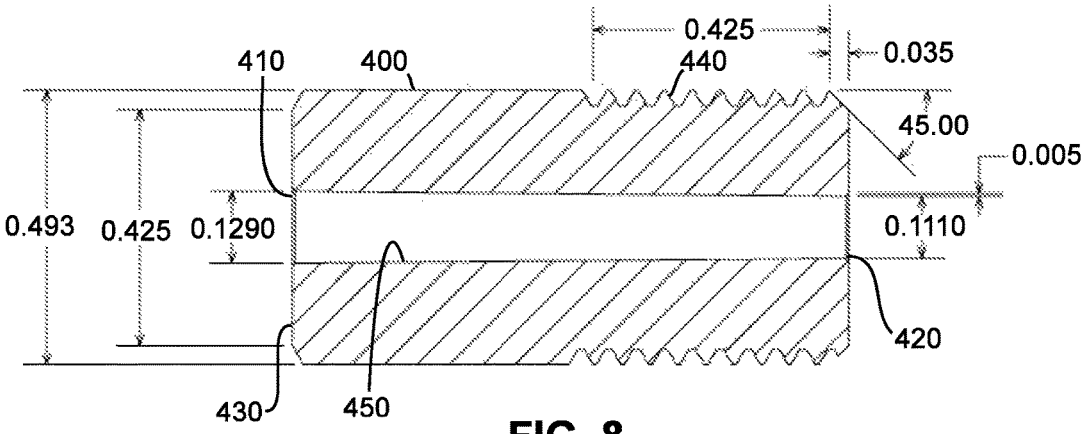
FIG. 8 is a to-scale cross-section of the coupler of FIG. 4 along the line 8-8 as shown in FIG. 7.

The measurements shown as numbers in FIGS. 5 and 7-8 are the dimensions of coupler 400 in inches. The manufacturing tolerance of any measurement express as three digits to the right of the decimal point is plus or minus 0.005 inches. The manufacturing tolerance of any measurement express as four digits to the right of the decimal point is plus or minus 0.001 inches.

Figure 9:
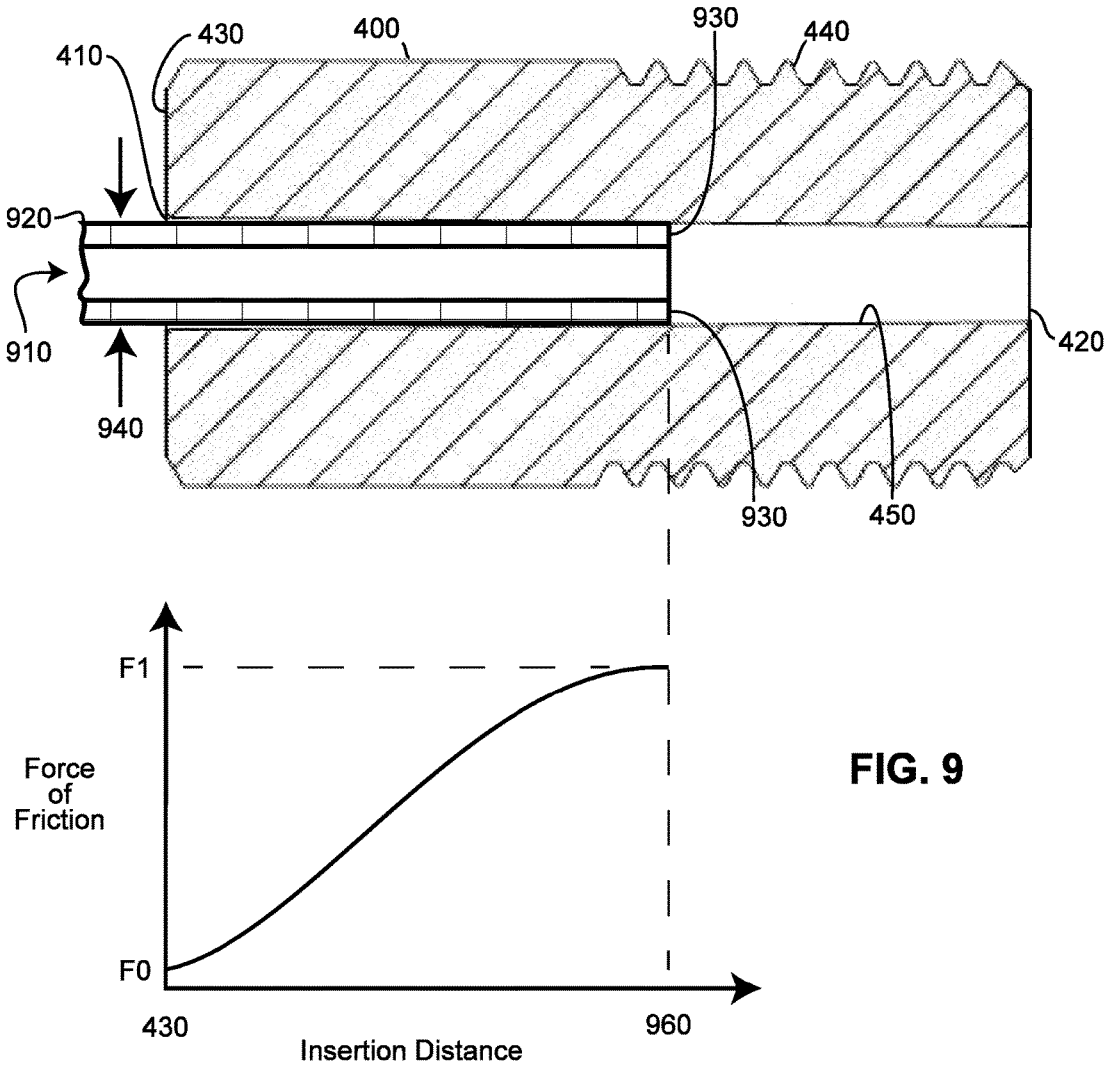
FIG. 9 is the cross-section view of FIG. 8 in juxtaposition with a diagram of the force against the outer walls of the shock tube.

The cross-section of coupler 400 shown in FIG. 9 is not to scale and shows shock tube 920 inserted into passage 450 of coupler 400. Shock tube 920 is an implementation of shock tube 130 and performs the functions of shock tube 130 and a shock tube discuss above. Any disclosure regarding shock tube 920 applies to shock tube 130 and/or shock tube 230 even if not expressly stated.

The explosive powder is not show on the interior (e.g., inside) of shock tube 920. Face 930 of shock tube 920 is the end of the end portion of shock tube 920 that is inserted into coupler 400.

The surface area of face 930 is the thickness (e.g., outside diameter minus inside diameter) of shock tube 920 around its entire circumference. The back-pressure acts on face 930 and/or the end portion of shock tube 920 to push shock tube 920 out of passage 450. The force of back-pressure on face 930 and/or the end portion of shock tube 920 is sufficient to push shock tube 920 out of passage 450 to accomplish automatic decoupling of shock tube 920 from coupler 400 after the firing of disrupter cannon 110 is started (e.g., initiated).

Coupler 400 couples to a disrupter cannon (e.g., 110) and remains coupled before, during and after firing. Coupler 400 may remain coupled to a disrupter cannon during several firings of the disrupter cannon and be removed only when damaged or to be cleaned. A coupler may couple to a disrupter cannon in any conventional manner. For example, coupler 400 couples to disrupter cannon 110 using threads 440. The firing pressure and/or the back-pressure does not decoupled coupler 140, 240, or 400 from the disrupter cannon.

In preparing to fire system 100 or 200, an end portion of shock tube 920 is inserted into inlet 410 and into passage 450. Passage 450 is tapered from inlet 410 to outlet 420. Near inlet 410, the outer surface of shock tube 130 may not contact or only partially contact the inner surface of passage 450. As shock tube 920 is pressed (e.g., inserted) into inlet 410, more of the outer surface of shock tube 920 comes into contact with the inner surface of passage 450. The farther shock tube 920 is pressed into passage 450, the greater the force applied by the inner wall of passage 450 against the outer wall of shock tube 920. Further, a crimping (e.g., pressing, compression) force of inner wall of passage 450 on the end portion of shock tube 920 may further acts to hold shock tube 920 in coupler 400. The forces applied by the walls of passage 450 on shock tube 920 include a compression force and/or a force of friction.

A graph of the force on shock tube 920 along the length of shock tube 920 that ins inserted into passage 450 is shown below coupler 400 in FIG. 9. The distance that shock tube 920 is inserted into passage 450 is measured from face 430 to the end of shock tube 920 at face 930.

Upon initially inserting shock tube 920 into passage 450 the force against an outer surface of shock tube 920 is F0. Force F0, may be zero or very low. Shock tube 920 may be manually inserted (e.g., pressed, pushed) into passage 450 until it cannot be manually inserted any more. The force on the end portion of shock tube 920 when inserted is force F1. The force on shock tube 920 will vary along a length of the inserted end portion of shock tube 920. The force exerted on shock tube 920 by passage 350 cannot be so great that the force applied by the back-pressure cannot act on face 930 and on the end portion of shock tube 920 to push shock tube 920 out of passage 450. Further, the force exerted on shock tube 920 by passage 450 cannot be so little that the force of the firing-pressure pushes shock tube 920 out of passage 450.

The force exerted by the inner walls of passage 450 on shock tube 920 is referred to as the disconnect force. A force acting on face 930 and end portion of shock tube 920 that is less than the disconnect force will not push shock tube 920 out of coupler 400. A force acting on face 930 and end portion of shock tube 920 that is greater than the disconnect force will push shock tube 920 out of coupler 400.

Factors that determine the amount of force exerted by passage 450 on the end portion of shock tube 920 include, the amount of the taper from inlet 410 to outlet 420, the area of face 930 (e.g., related to thickness of shock tube 130), the outside diameter of shock tube 130, the compressibility of shock tube 130, and the smoothness of the inner walls of passage 450.

Conventional shock tube has an outside diameter of about 0.120 inches. The outside diameter of conventional shock tube may range from 0.115 to 0.125 inches. Conventional shock tube has an inner (e.g., inside) diameter of about 0.045 inches. The inside diameter of conventional shock tube may range from 0.040 to 0.050 inches. For shock tube 920 with an outside diameter of 0.120 and an inside diameter of 0.045, the area of face 930 is 0.00972 inches squared.

The diameter of passage 450 at inlet 410 is 0.129 inches and the diameter of passage 450 at outlet 420 is 0.111 inches. The diameter of passage 450 tapers evenly (e.g., uniformly) between inlet 410 and output 420. as shown in FIG. 8, which is to scale. In an implementation, coupler 400 is formed of brass. The inner walls of passage 450 are bored and reamed, but not polished, and shock tube 920 is formed of plastic.

Although specific measurements are provided for the implementation of coupler 400, the same principles of firing-pressure, back-pressure, pressure exerted on the shock tube by the inner walls of the passage in a coupler are applicable to shock tube of any diameter.

Figure 3:
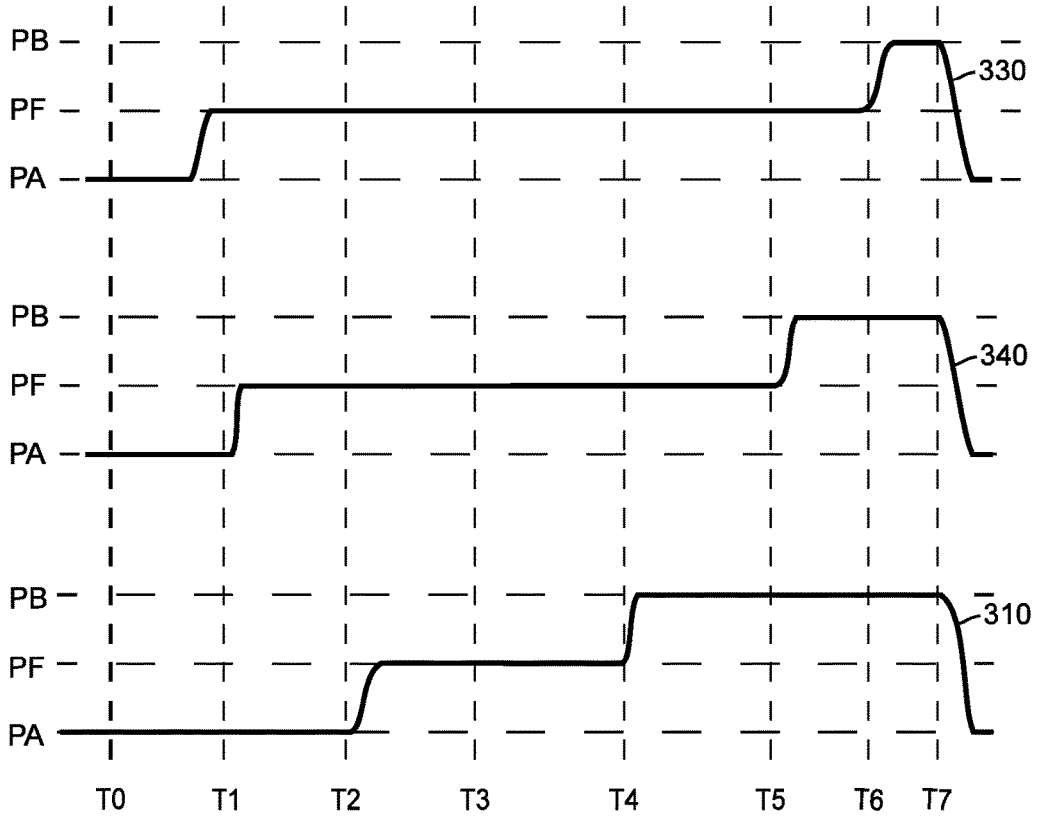
FIG. 3 is a diagram of the air pressure in the system of FIGS. 1 and 2 during operation of the system.
Figure 4:
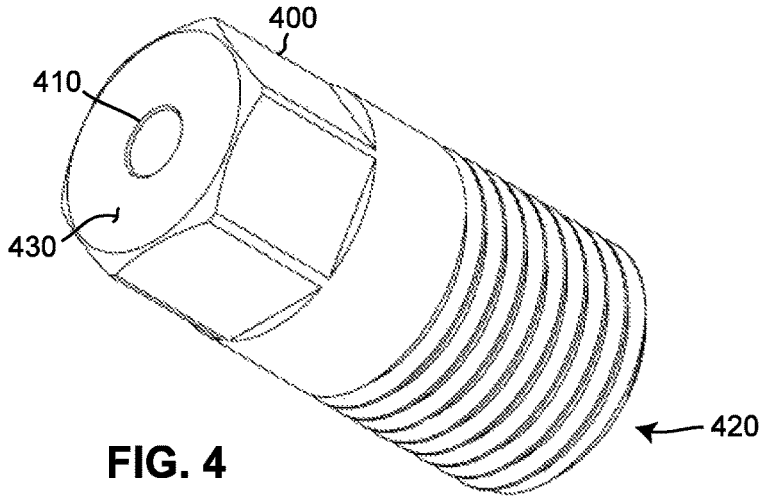
FIG. 4 is a to-scale perspective view of a coupler showing a front view, a side view, and a bottom view of the coupler, according to various aspects of the present disclosure.

Pressure graphs 330, 340, and 310 of FIG. 3 show the gas pressure in shock tube 130 (230, 920), coupler 140 (240), and disrupter cannon 110 (210) respectively before, during, and after firing disrupter cannon 110 (210).

The y-axis for each of the three graphs shows the gas pressure in the respective components of system 100 (200). Pressure PA is atmospheric pressure prior to igniting shock tube 920. Pressure PF is the firing-pressure established by the force of the expanding gas provided by shock tube 920 after shock tube 920 is ignited. Pressure PB is the back-pressure establish by the reflection of the firing-pressure from the firing pin. Pressure PB is greater than pressure PF. Pressure PF is greater than PA. Pressure PA is about the atmospheric pressure in the location where disrupter cannon 110 is located.

The three graphs of gas pressure share a common x-axis. The x-axis shows time. Events that occur during the operation of disrupter cannon 110 are indicated as T0 through T6.

At time T0, shock tube 130 is coupled to coupler 400, which is coupled to disrupter cannon 110 prior to igniting shock tube 920. The gas pressure in shock tube 920, coupler 400, and the passage in disrupter cannon 110 are all at about atmospheric pressure PA.

The pressure required to push shock tube 920 out of coupler 400 is referred to herein as the disconnect-pressure. For automatic decoupling, the disconnect-pressure is greater than pressure PF, but less than pressure PB. As long as the pressure in passage 450 is below the disconnect-pressure, shock tube 920 remains inserted into coupler 400. When the pressure in passage 450 reaches or exceeds the disconnect-pressure, the gas pressure will push shock tube 920 out of coupler 400 thereby decoupling shock tube 920 from coupler 400. The disconnect-pressure is affected (e.g., determined) by the factors discussed above.

Upon igniting shock tube 920 at its far end (e.g., end opposite end 930), at time T0, the pressure inside shock tube 920 begins to increase along its length and a wave of gas pressure travels the length of shock tube 920 toward coupler 400. The expanding gas due to ignition of the explosive powder in shock tube 920 increases the gas pressure inside shock tube 920 from pressure PA to pressure PF.

By time T1, the wave of gas pressure at pressure PF through shock tube 920 reaches coupler 400 and enters passage 450 of coupler 400, so the pressure inside coupler 400 increases from pressure PA to pressure PF By time T2, the wave of gas pressure travels through coupler 400, exits outlet 420 of coupler 400, enters into the passage in disrupter cannon 110 that leads to the firing pin. The increase in the gas pressure travels the passage inside disrupter cannon 110 until it reaches the firing pin.

At time T3, the rapidly expanding gas from shock tube 920 moves the firing pin into the firing position so that the primer of the cartridge is ignited and the cartridge is fired to launch the projectile.

At time T4, the expanding gas from shock tube 920 has filled the passage inside disrupter cannon 110 and has no more volume to fill or any place for the expanding gas to escape, so the pressure inside the passage increases. Because there is no outlet or path for the expanding gas to escape near the firing pin, the pressure inside the passage of disrupter cannon 110 increases from pressure PF to pressure PB. Much like a wave, pressure PB reflects from the passage at the firing pin and begins to travel away from the firing pin, along the passage, and out of disrupter cannon 110.

At time T5, the increased pressure exits the passage of disrupter cannon 110 and enters outlet 420 of coupler 400 thereby increasing the gas pressure inside channel 450 of coupler 400 from pressure PF to pressure PB.

At time T6, the increased pressure in passage 450 of coupler 400 reaches face 930 and the end portion of shock tube 920 that is inserted into passage 450. The increased pressure also enters shock tube 920. The increased pressure PB operates on face 930 and the end portion of shock tube 920 to move shock tube 920 toward inlet 410 of coupler 400.

The increased gas pressure PB continues to act on face 930 and the end portion of shock tube 920 until at time T7, shock tube 920 is pushed completely from passage 450 thereby decoupling shock tube 920 from coupler 400. Once shock tube 920 decouples from coupler 400, the gas pressure in shock tube 920, coupler 400, and disrupter cannon 110 quickly falls to pressure PA.

The magnitude of the back-pressure (e.g., pressure PB) may be limited by providing a vent in the passage of the disrupter cannon and/or in coupler 400. In an implementation, little or none of the rapidly expanding gas provided by the shock tube escapes from the disrupter cannon thereby providing the highest value for pressure PB.

The magnitude of the back-pressure may be reduced by providing a vent from the disrupter cannon and/or the coupler to the atmosphere. The amount of gas released by the vent may be adjusted thereby adjusting the magnitude of the back-pressure. The amount of gas released by the vent may be increased to reduce the magnitude of the back-pressure or decreased to increase the magnitude of the back-pressure. However, the magnitude of the back-pressure (e.g., pressure PB) should not be reduced below the amount of pressure required to disconnect shock tube 920 from disrupter cannon 110 automatically. Further, the amount of gas passed through vent should not decrease the firing-pressure (e.g., pressure PF) to be too low so that the gas pressure cannot move the firing pin to activate the cartridge.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'comprises', 'including', 'includes', 'having', and 'has' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing". The invention includes any practical combination of the structures and methods disclosed. While for the sake of clarity of description several specifics embodiments of the invention have been described, the scope of the invention is intended to be measured by the claims as set forth below.

The words "herein", "hereunder", "above", "below", and other word that refer to a location, whether specific or general, in the specification shall refer to any location in the specification.

What is claimed is:

1. A coupler for automatically decoupling a provided shock tube from the coupler after firing a provided disrupter cannon to launch a provided projectile toward a provided explosive device, the coupler comprising:
- an inlet;
- an outlet; and
- a passage between the inlet and the outlet; wherein:
  - a diameter of the inlet is greater than a diameter of the outlet;
  - the passage tapers from the inlet to the outlet;
  - while an end portion of the shock tube is inserted into the passage, an interior wall of the passage exerts a first force on the shock tube to retain the shock tube in the passage;
  - a second force provided by an expanding gas from igniting the shock tube:
    - (1) moves a provided firing pin to fire the disrupter cannon to launch the projectile toward the explosive device; and
    - (2) moves the shock tube out of the passage thereby automatically decoupling the shock tube from the coupler.

2. The coupler of claim 1 wherein the second force is greater than the first force.

3. The coupler of claim 1 wherein the taper from the inlet to the outlet is uniform.

4. The coupler of claim 1 wherein the diameter of the inlet is about 0.129 inches.

5. The coupler of claim 1 wherein the diameter of the outlet is about 0.111 inches.

6. The coupler of claim 1 wherein the coupler further comprises threads for coupling the coupler to the disrupter cannon.

7. The coupler of claim 1 wherein:
- the second force includes a first magnitude and a second magnitude;
- the second force at the first magnitude moves the firing pin; and
- the second force at the second magnitude moves the shock tube out of the passage.

8. The coupler of claim 7 wherein the second magnitude is greater than the first magnitude.

9. A system for propelling a provided projectile toward a provided explosive device, the system comprising:
- a coupler, the coupler includes an inlet, an outlet, and a passage between the inlet and the outlet;
- a length of shock tube, a first end portion of the shock tube inserted into the passage of the coupler via the inlet;
- a disrupter cannon, the disrupter cannon includes a firing pin, the coupler mechanically coupled to the disrupter cannon so that the outlet of the coupler is in fluid communication with the firing pin; wherein:
- the passage tapers from the inlet to the outlet;
- igniting the shock tube increases a gas pressure in the coupler and the disrupter cannon to a first magnitude followed by an increase in the gas pressure to a second magnitude, the first magnitude less than the second magnitude;
- the gas pressure at the first magnitude applies a first force on the firing pin to move the firing pin to fire the disrupter cannon to propel the projectile toward the explosive device; and the gas pressure at the second magnitude applies a second force on the first end portion of the shock tube to push the shock tube out of the coupler thereby disconnecting the shock tube from the coupler.

10. The coupler of claim 9 wherein the first magnitude of the gas pressure is insufficient to move the shock tube out of the coupler.

11. The coupler of claim 9 wherein a force of an inner wall of the passage on an outer surface of the shock tube retains the shock tube in the coupler until the gas pressure in the coupler is greater than the first magnitude.

12. The coupler of claim 9 wherein:

the disrupter cannon further comprises an outlet; and the outlet of the disrupter cannon reduces the second magnitude of the gas pressure.

13. A coupler for automatically decoupling a provided shock tube from the coupler after firing a provided disrupter cannon to launch a provided projectile toward a provided explosive device, the coupler comprising:

an inlet;

an outlet; and a passage between the inlet and the outlet; wherein:

a diameter of the passage proximate to the inlet is greater than the diameter of the passage proximate to the outlet;

the passage tapers between the inlet to the outlet;

while an end portion of the shock tube is inserted into the passage via the inlet, an interior wall of the passage exerts a first force on the shock tube to retain the shock tube in the passage;

a second force provided by an expanding gas from igniting the shock tube:

(1) moves a provided firing pin to fire the disrupter cannon to launch the projectile toward the explosive device; and (2) moves the shock tube out of the passage thereby automatically decoupling the shock tube from the coupler.

14. The coupler of claim 13 wherein the second force is greater than the first force.

15. The coupler of claim 13 wherein the diameter of the passage proximate to the inlet is about 0.129 inches.

16. The coupler of claim 13 wherein the diameter of the passage proximate to the outlet is about 0.111 inches.

17. The coupler of claim 13 wherein:

the second force includes a first magnitude and a second magnitude;

the second force at the first magnitude moves the firing pin; and the second force at the second magnitude moves the shock tube out of the passage.

18. The coupler of claim 17 wherein the second magnitude is greater than the first magnitude.

19. The coupler of claim 13 wherein the outlet comprises threads for coupling the coupler to the disrupter cannon.

* * * * *